US008814588B2

(12) United States Patent
Wang et al.

(10) Patent No.: US 8,814,588 B2
(45) Date of Patent: Aug. 26, 2014

(54) ELECTRICAL CONNECTOR WITH LOCKING PORTIONS FOR AN INSERTING COMPONENT

(71) Applicant: Hon Hai Precision Industry Co., Ltd., New Taipei (TW)

(72) Inventors: Cheng-Wei Wang, New Taipei (TW); Hsiu-Yuan Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 38 days.

(21) Appl. No.: 13/651,490

(22) Filed: Oct. 15, 2012

(65) Prior Publication Data

US 2013/0095675 A1 Apr. 18, 2013

(30) Foreign Application Priority Data

Oct. 14, 2011 (TW) ..... 100219334

(51) Int. Cl.
*H01R 13/627* (2006.01)

(52) U.S. Cl.
USPC ..... 439/358

(58) Field of Classification Search
USPC ..... 439/352–358, 260, 329, 62
See application file for complete search history.

(56) References Cited

U.S. PATENT DOCUMENTS

| | | | | |
|---|---|---|---|---|
| 5,171,161 | A * | 12/1992 | Kachlic | 439/352 |
| 7,001,208 | B2 * | 2/2006 | Huang | 439/495 |
| 7,029,334 | B2 * | 4/2006 | Shibuya | 439/660 |
| 7,850,473 | B1 | 12/2010 | Ozeki | |
| 8,002,567 | B2 * | 8/2011 | Hara | 439/329 |
| 8,303,321 | B1 * | 11/2012 | Little | 439/159 |
| 8,303,322 | B1 * | 11/2012 | Little et al. | 439/159 |
| 8,376,762 | B2 * | 2/2013 | Ozeki | 439/153 |
| 2004/0248447 | A1 * | 12/2004 | Aoki | 439/260 |
| 2009/0078421 | A1 * | 3/2009 | Guignard et al. | 166/298 |
| 2009/0246998 | A1 * | 10/2009 | Wu | 439/352 |
| 2011/0104931 | A1 * | 5/2011 | Wu | 439/358 |
| 2012/0129370 | A1 * | 5/2012 | Zhou et al. | 439/188 |

* cited by examiner

*Primary Examiner* — Chandrika Prasad
(74) *Attorney, Agent, or Firm* — Wei Te Chung; Ming Chieh Chang

(57) ABSTRACT

An electrical connector includes an insulating housing defining a mating slot, a plurality of conductive terminals retained in the insulating housing and a shielding shell attached to the insulating housing. The terminals include contacting portions exposed to the mating slot and solder portions. The shielding shell includes a pair of connecting portions integrally extending in the mating slot, a locking portion integrally extending from each connecting portion and exposed to the mating slot and a releasing portion integrally extending from each connecting portion to the shell with an operating portion at one outer side of the connector. The locking portions move away from the mating slot in response to a movement of the releasing portions to the mating slot.

20 Claims, 18 Drawing Sheets

ELECTRICAL CONNECTOR WITH LOCKING PORTIONS FOR AN INSERTING COMPONENT

BACKGROUND OF THE INVENTION

1. Field of the Invention

The present invention relates generally to an electrical connector, and more particularly to an improvement in an electrical connector which has a housing, holding means for engaging with a flexible flat circuit device inserted in the housing, so as to hold the same to be prevented from getting out of the housing unwillingly.

2. Description of Related Art

U.S. Pat. No. 7,850,473 discloses an electrical connector connecting with a flexible flat circuit board, which includes an insulating housing with receiving room for receiving flexible flat circuit board and conductive shell covering on the housing. The shell defines a locking element and the housing defines a release element extending out of the shell at one end of the release element. The locking element engages with the edges of the inserted flexible flat circuit board so as to prevent the board. When the release element is pushed to the interior of the shell, another end of the release element shift as so to unlock with the board. The board can be drawn out of the receiving room.

As known, the locking element and the release element are disposed at the shell and the insulating housing respectively, which will result in a complex structure of the locking and release elements and a delay of the release process.

SUMMARY OF THE INVENTION

Accordingly, an object of the present invention is to provide an electrical connector with an improvement of a locking-release element.

In order to achieve the above-mentioned object, an electrical connector comprises an insulating housing defining a mating slot, a plurality of conductive terminals retained in the insulating housing and a shielding shell attached to the insulating housing. The terminals comprise contacting portions exposed to the mating slot and solder portions. The shielding shell comprises a pair of connecting portions integrally extending in the mating slot, a locking portion integrally extending from each connecting portion and exposed to the mating slot and a releasing portion integrally extending from each connecting portion to the shell with an operating portion at one outer side of the connector. The locking portions move away from the mating slot in response to a movement of the releasing portions to the mating slot.

Other objects, advantages and novel features of the present invention will become more apparent from the following detailed description of the present embodiment when taken in conjunction with the accompanying drawings.

DETAILED DESCRIPTION OF THE INVENTION

The present invention will now be described in detail with reference to a preferred embodiment thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

Referring to FIGS. 1 through 9, a first embodiment of an electrical connector 1 according to certain teachings of the present disclosure is illustrated, which is intended to be mounted on a mother board and receiving flexible flat circuit board 2 so as to establish an electrical connection between the mother board and the flexible flat circuit board 2.

Figure 4:
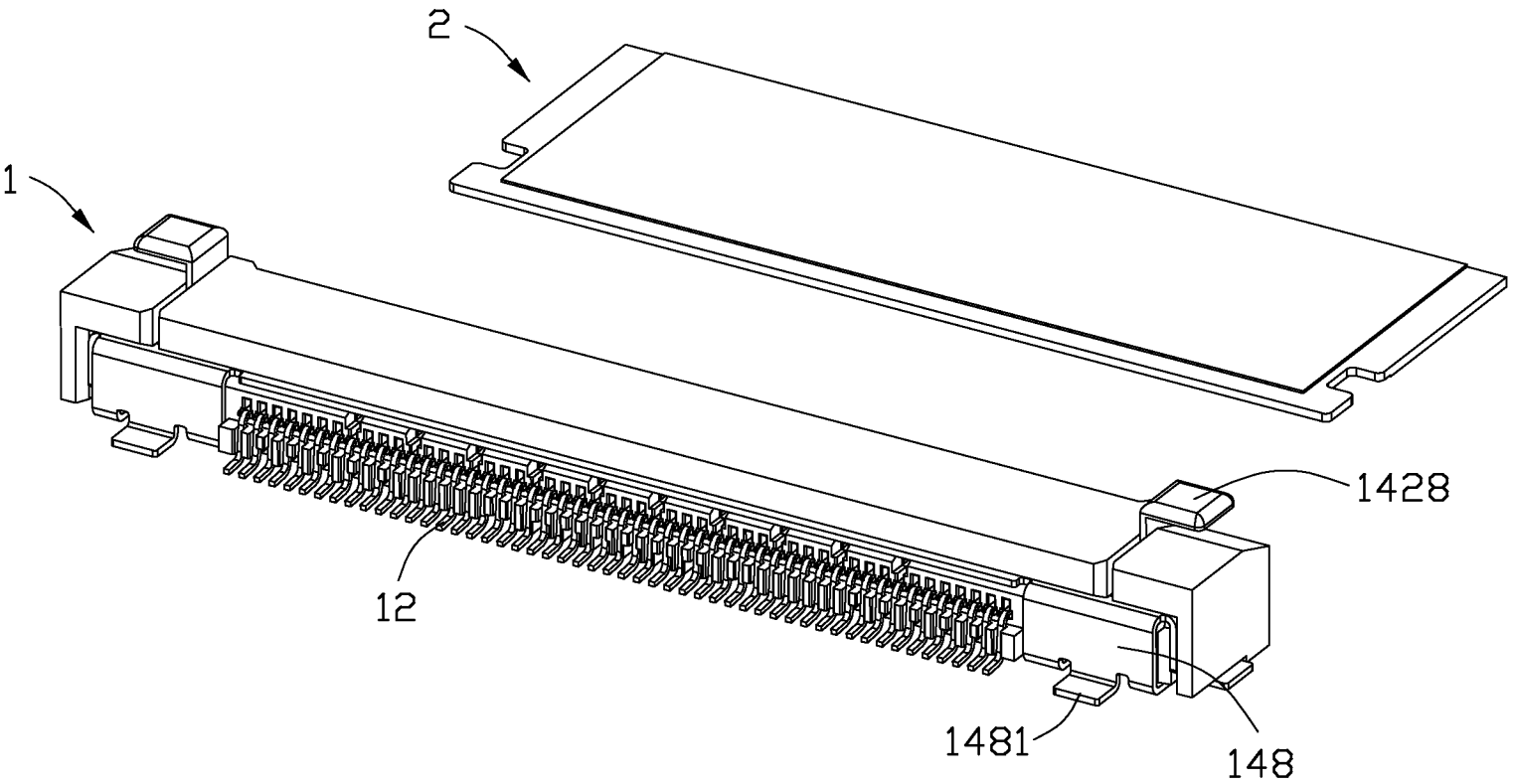
FIG. 4 is a rear perspective view of the assembly shown in FIG. 3.
Figure 5:
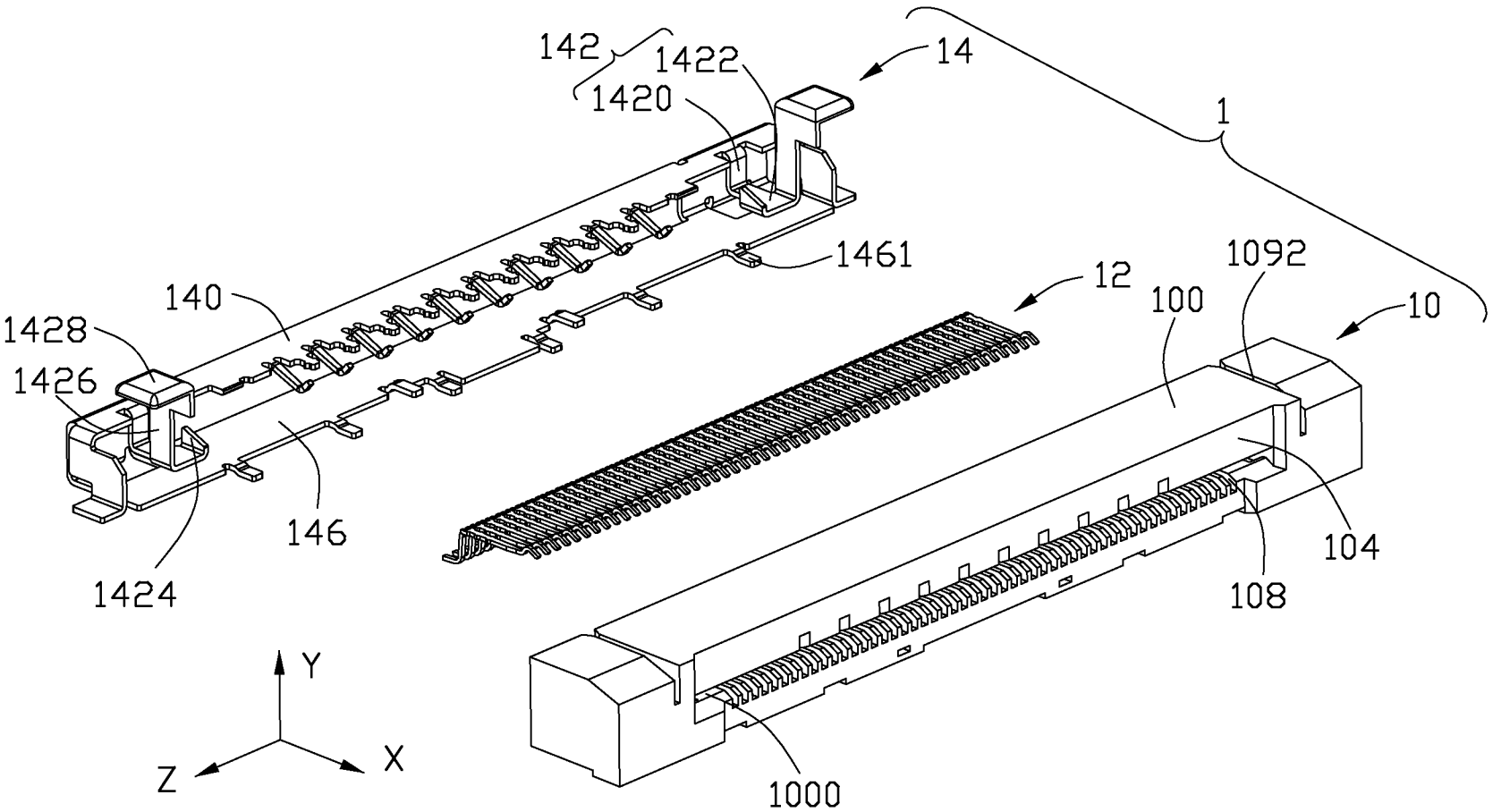
FIG. 5 is a front exploded perspective view of the electrical connector shown in FIG. 3.
Figure 6:
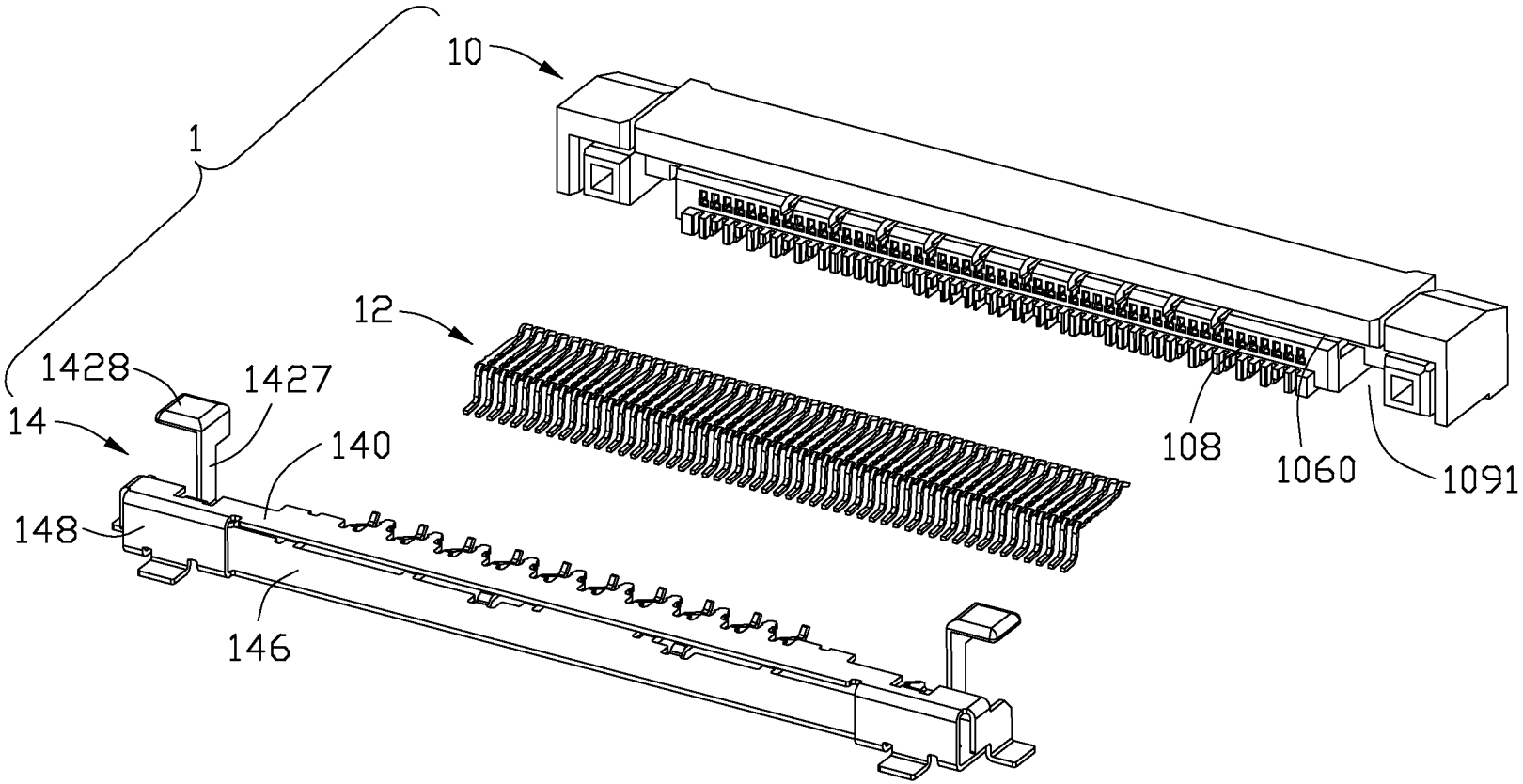
FIG. 6 is a rear exploded perspective view of the connector shown in FIG. 4.

Referring to FIGS. 5 and 6. the electrical connector 1 includes a longitudinal insulating housing 10, a plurality of terminals 12 and a shielding shell 14. The housing 10 defines a mating slot 1000 opening forward through a front face 104 and extending in a first direction X, which is intended to be inserted with the flexible flat circuit board 2 as shown in FIG. 1 through 4. A plurality of terminal passageways 108 communicating with the mating slot 1000 and through a rear face 106 labeled in FIG. 2 to receive said plurality of terminals 12, with elastic contacting portion 120 (labeled in FIG. 7) exposing to the mating slot 1000 and solder portions 121 along the rear face.

Figure 7:
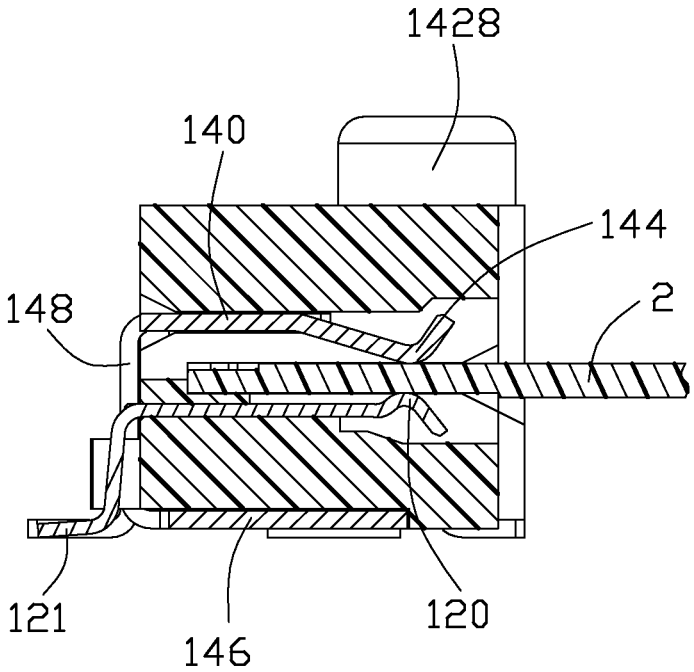
FIG. 7 is a cross-sectional view of the assembly taken along lines 7-7 in FIG. 1.

The shielding shell 14 of a frame shape includes a top first wall 140, a bottom second wall 146 opposite to the first wall and a pair of connecting walls 148 jointing the first and second walls at rear edges adjacent to two opposite longitudinal ends thereof. The first wall 140 is inserted an retained in a through slit 1060 defined in the rear face of the housing, the through slit 1060 connects with the mating slot 1000 so that a plurality of spring fingers 144 extending from a front edge thereof pass through the slit 1060 and expose to the mating slot 1000. The spring fingers face to the contacting portions 120 and deflectable in a second direction Y perpendicular to said first direction X as best shown in FIG. 7 to contact with the flexible board 2. The second wall 146 covers on the bottom 102 labeled in FIG. 1. The connecting walls 148 abut against the rear wall with a plurality of retaining tabs 1461 retained in the bottom wall of the housing.

Figure 1:
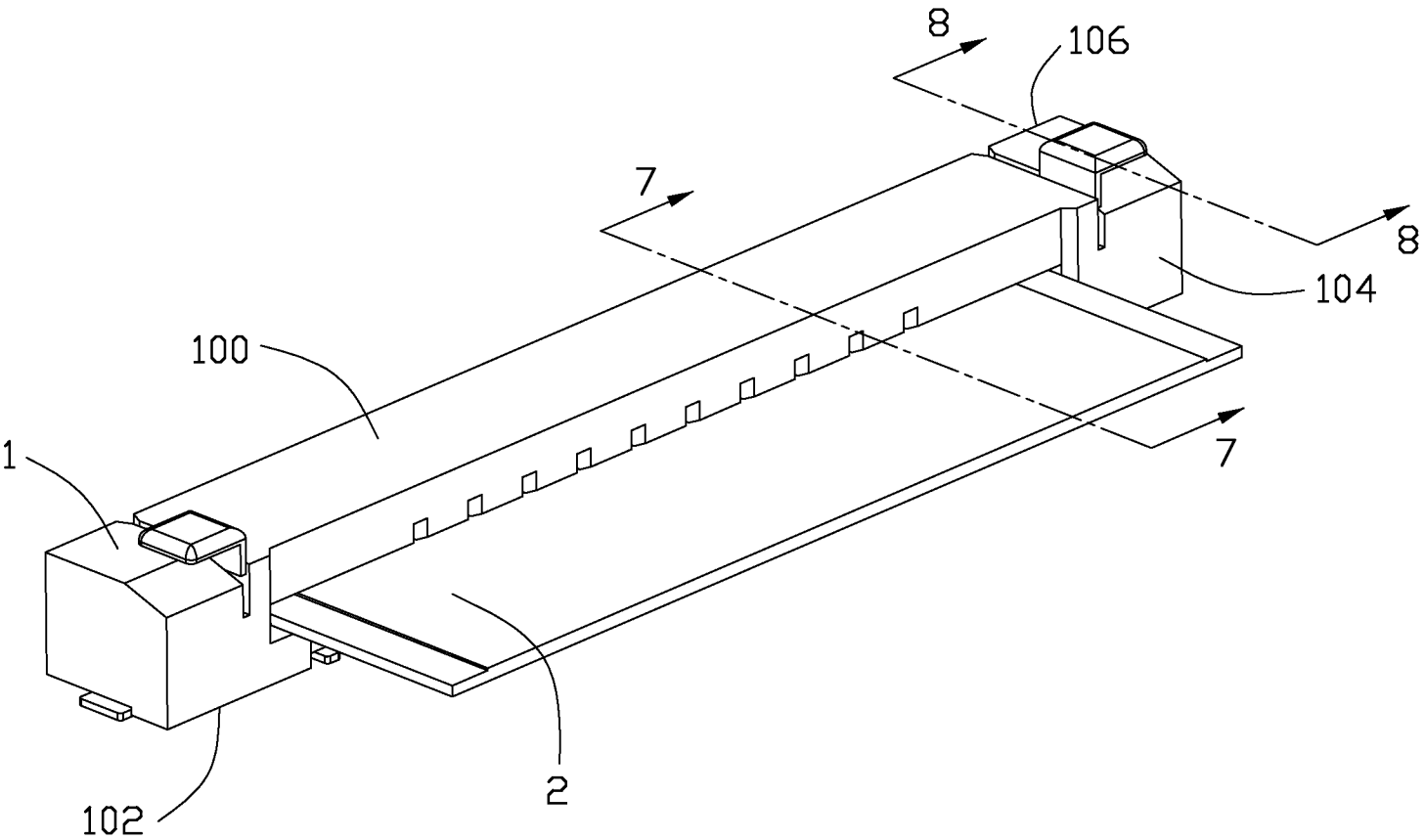
FIG. 1 is a front perspective view of an electrical connector assembly according to a first embodiment of the present invention, wherein the flexible flat circuit board connects with an electrical connector.
Figure 2:
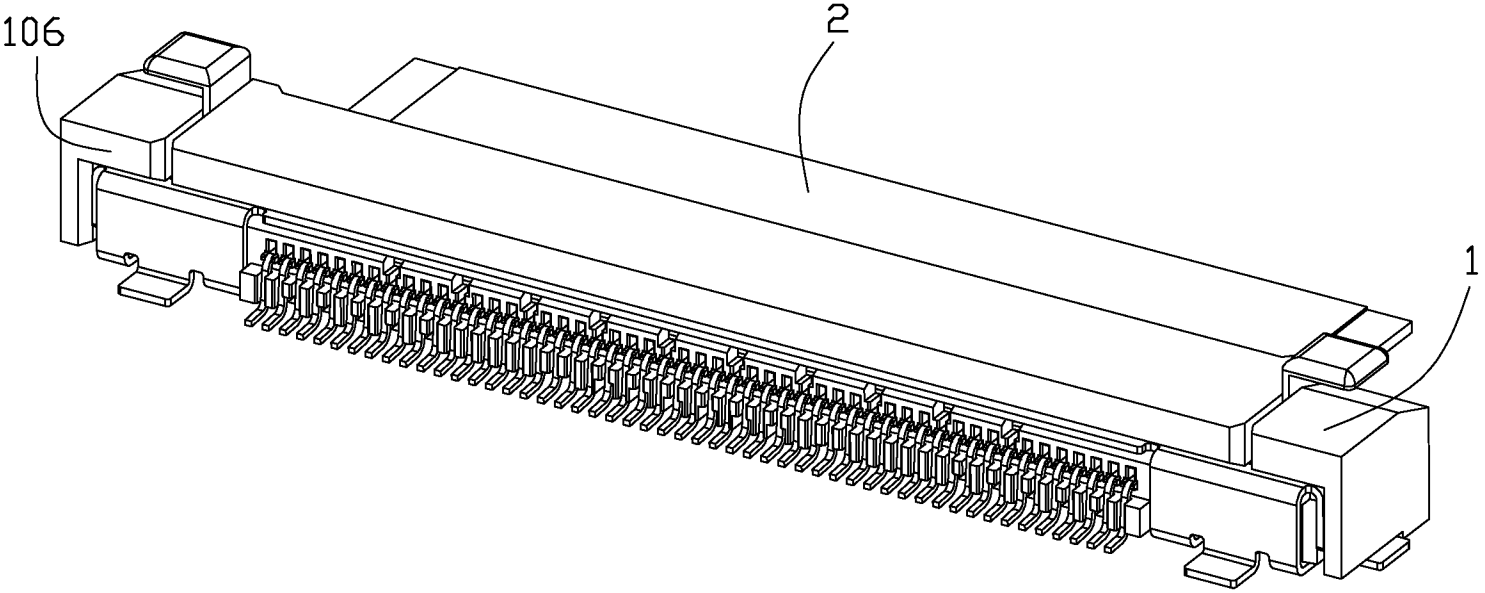
FIG. 2 is a rear perspective view of the assembly shown in FIG. 1.
Figure 3:
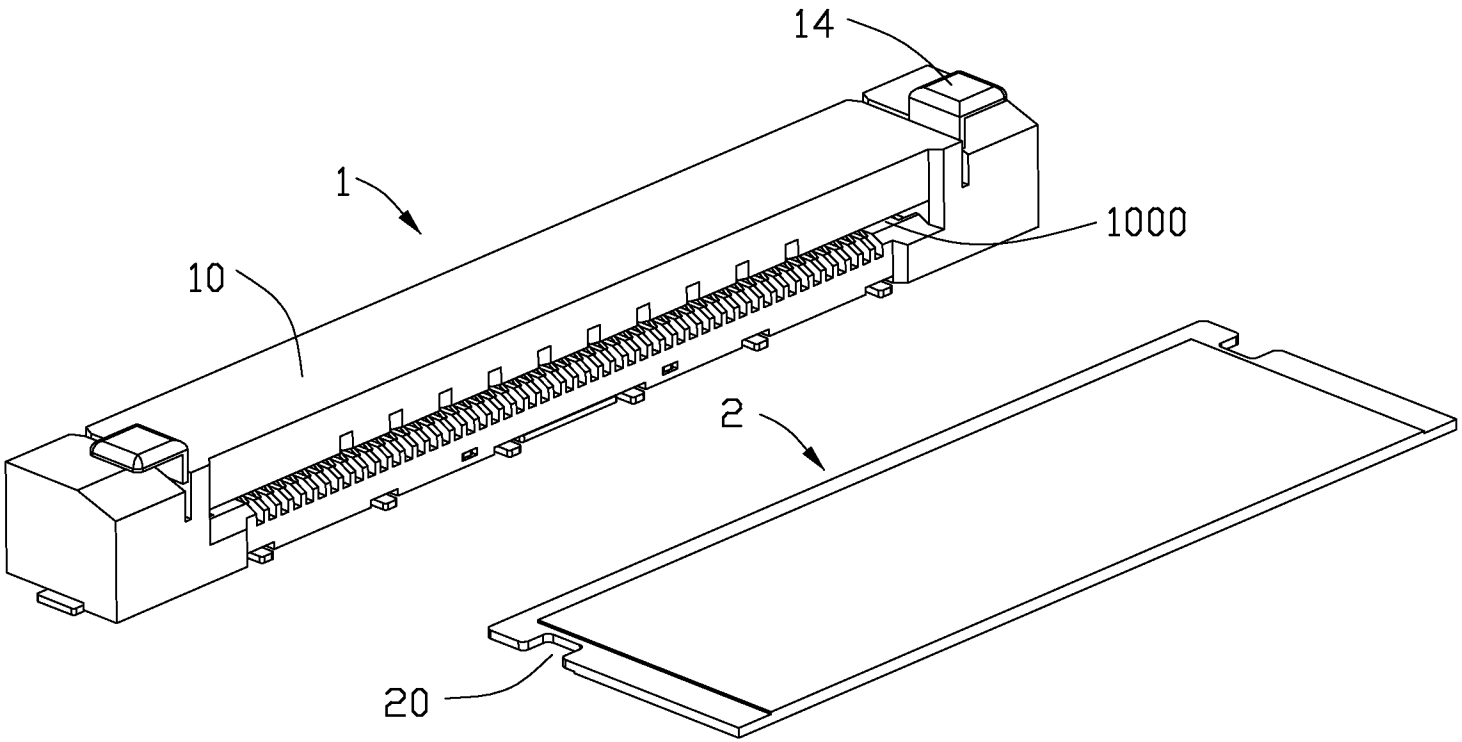
FIG. 3 is a front perspective view of the assembly shown in FIG. 1, wherein the flexible flat circuit board disconnects from the electrical connector.

The first wall 140 extends a pair of cantilever arms 142 adjacent two longitudinal ends. The housing defines a pair of cavity 1091 opening through a bottom and a rear face of the housing. The cantilever arms 142 are received in the cavity 1091 when the shielding shell is assembled to the housing from the rear face. As best shown in FIGS. 2 and 4, the connecting walls 148 are covered on the rear face of the housing and seal the cavity together with the second walls. A solder portion 1481 bends from a bottom of the connecting wall.

The cantilever 142 arm, also defined as a latch, includes an L-shaped connecting portion 1420 jointing with the front edge of the first wall 140. A locking portion 1424 projects upwards from one side of a first portion or horizontal portion 1422 of the connecting portion 1420 and a release portion 1426 extending upwards from another side of the first portion of the connecting portion 1420 and spaced from the locking portion 1424 in a third direction Z perpendicular to both said first direction X and said second direction Y. Combination with FIG. 8, the locking portion 1424 is in form of angle shaped tab projecting into the mating slot 1000. When the flexible flat circuit board is inserted into the opening 1000, the locking portions project into a corresponding notch 20 to prevent the outer-movement of the flexible flat circuit board 2. The release portions 1426 extend beyond the top of the housing and each define a free-end operating portion 1428 parallel to the first wall 140 of the shell. A vertical portion 1427 is defined on the release portion, which passes through a slot 1092 defined in the housing and connecting with the cavity 1091. Combination with FIG. 9, when push the operating portion 1428 downwards, the release portion 1426 drive the connecting portion 1420 downward and backwards, in a result that the locking portion 1424 shift downward and take away from the notch 20 of the board 2 so that the board can be pulled outwards.

Figure 8:
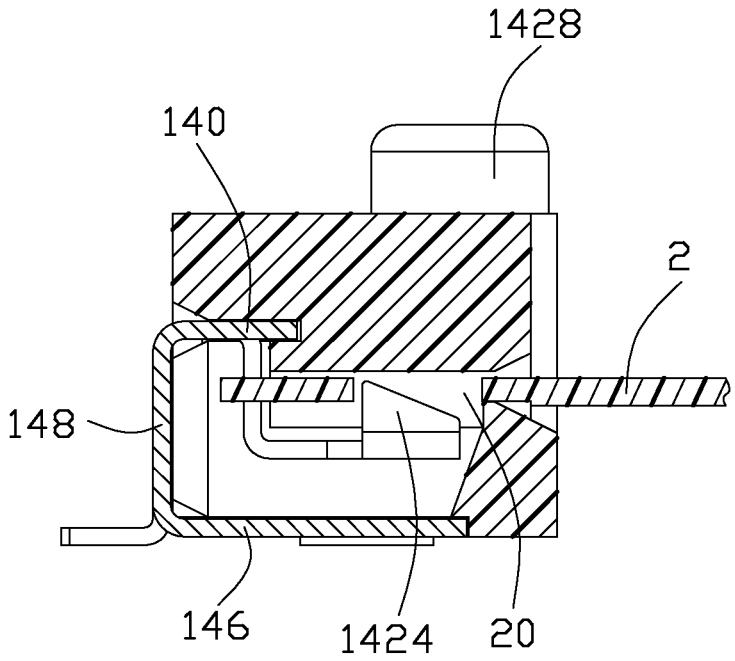
FIG. 8 is a cross-sectional view of the assembly taken along lines 8-8 in FIG. 1.
Figure 9:
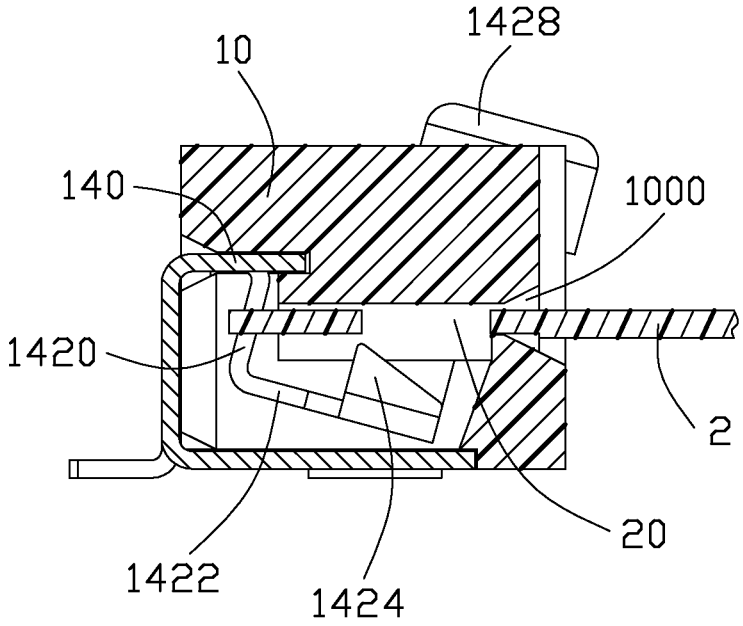
FIG. 9 is similar to FIG. 8, wherein the locking portion is pushed downward from the flexible flat circuit board.
Figure 10:
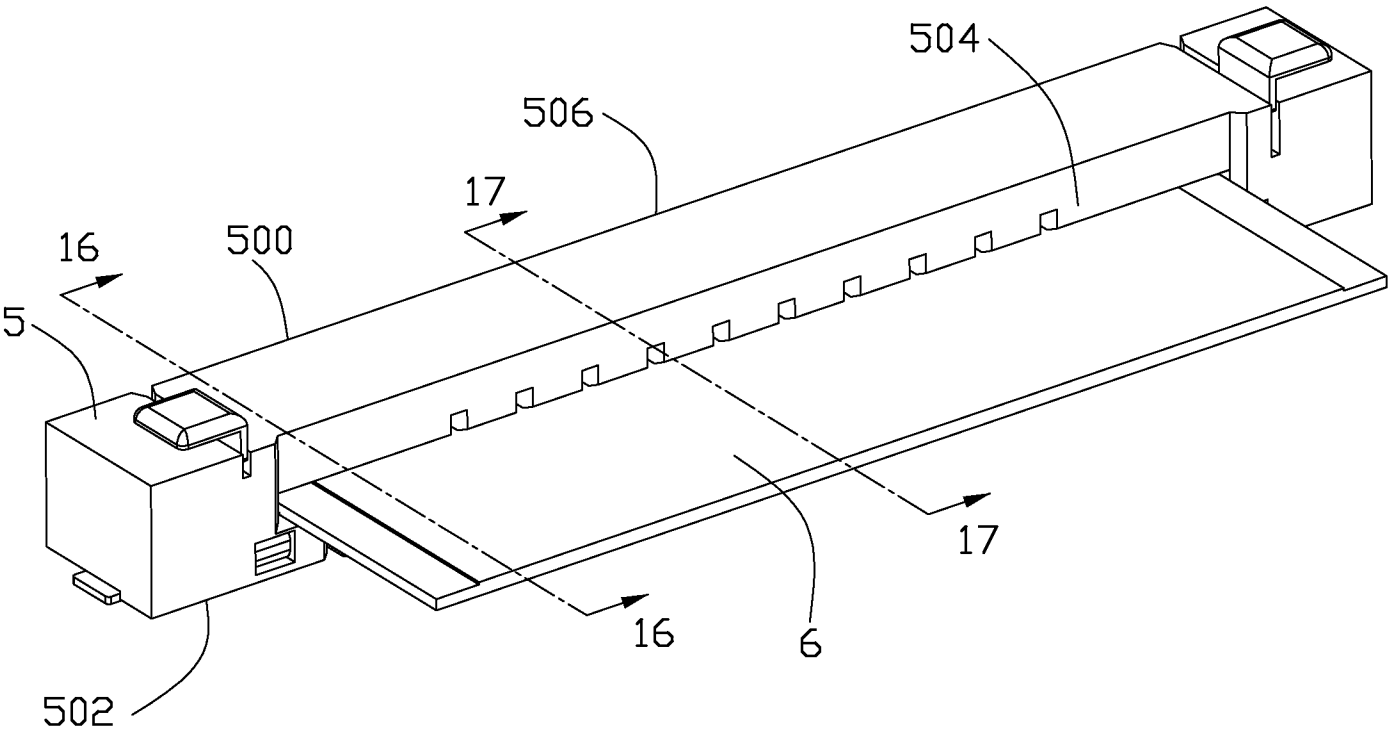
FIG. 10 is a front perspective view of an electrical connector assembly according to a second embodiment of the present invention, wherein the flexible flat circuit board connects with an electrical connector.
Figure 11:
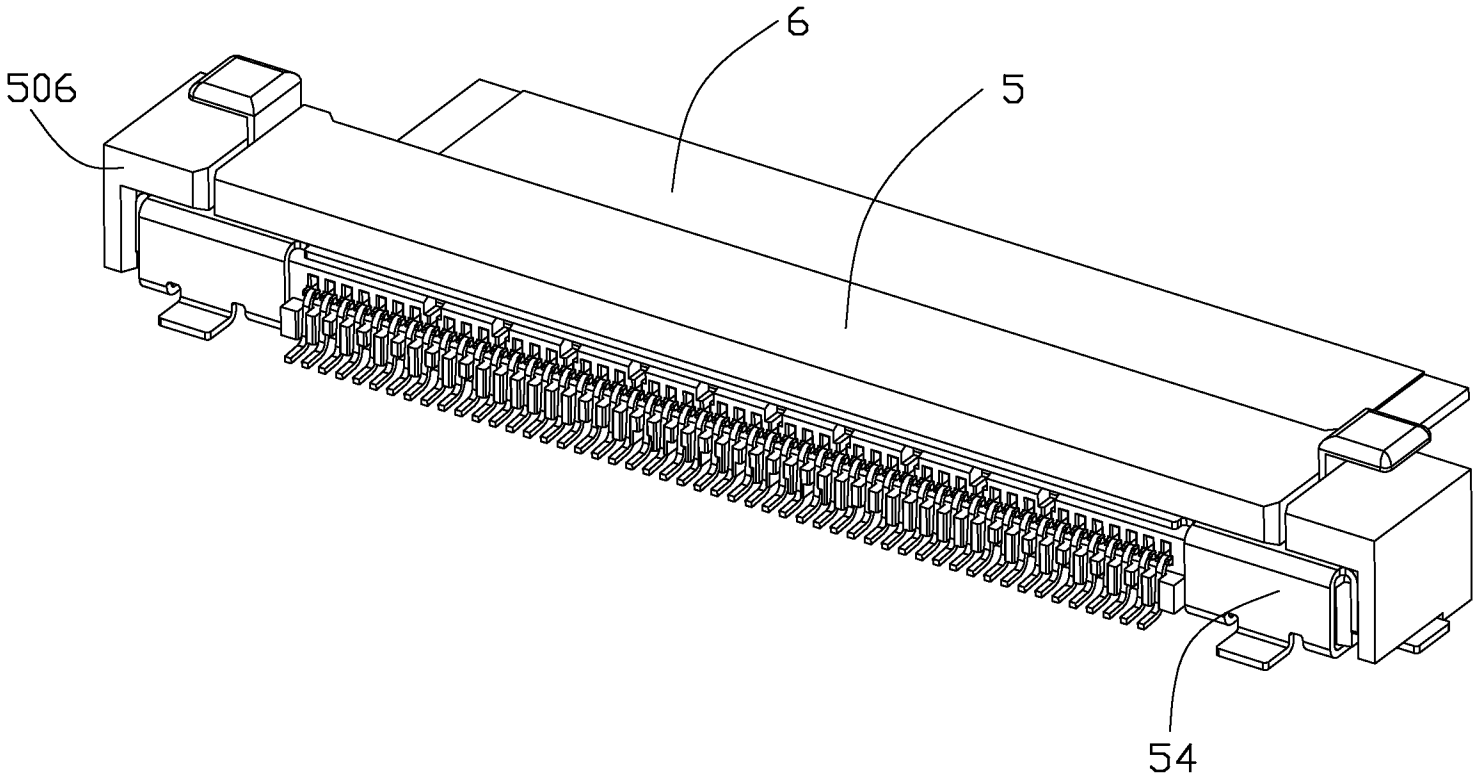
FIG. 11 is a rear perspective view of the assembly shown in FIG. 10.
Figure 12:
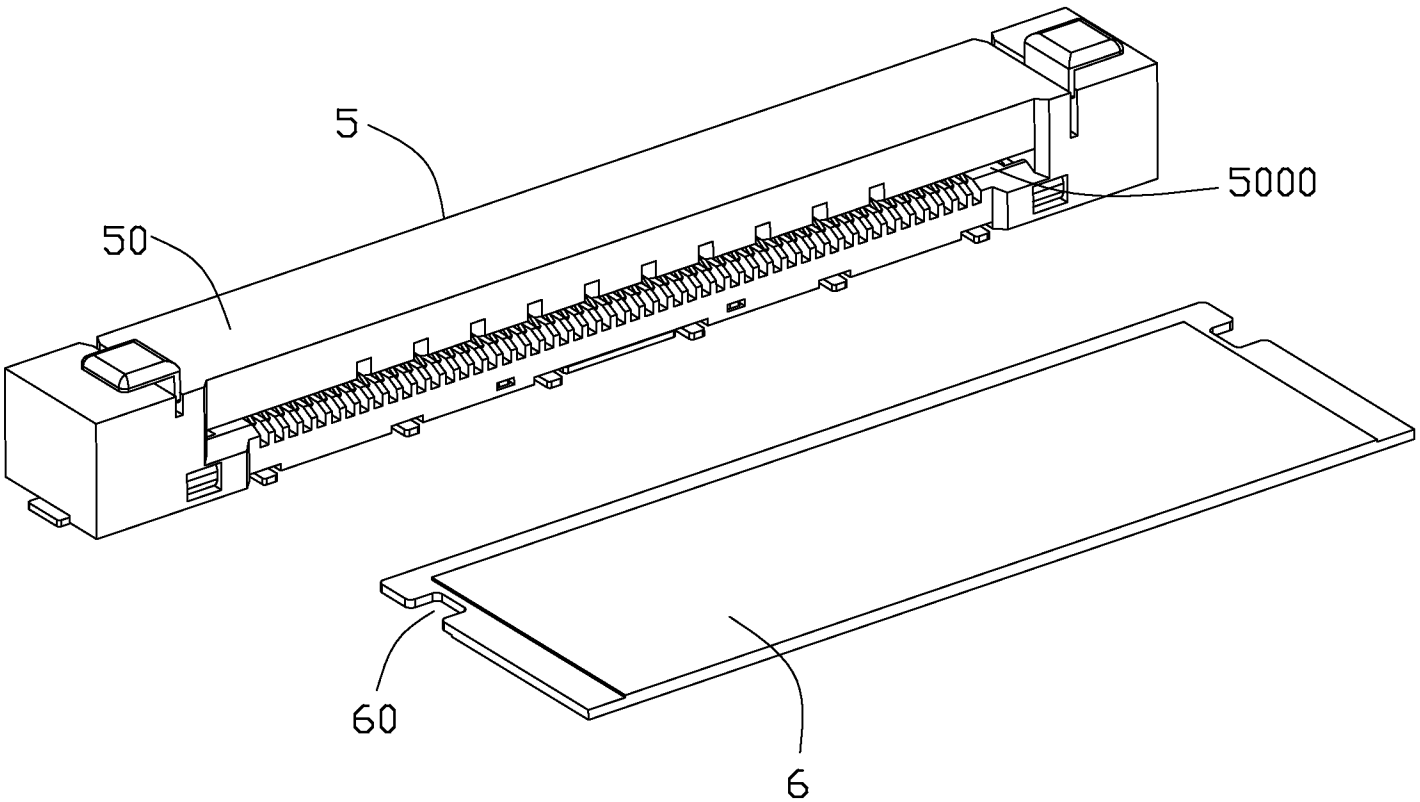
FIG. 12 is a front perspective view of the assembly shown in FIG. 10, wherein the flexible flat circuit board disconnects from the electrical connector.
Figure 13:
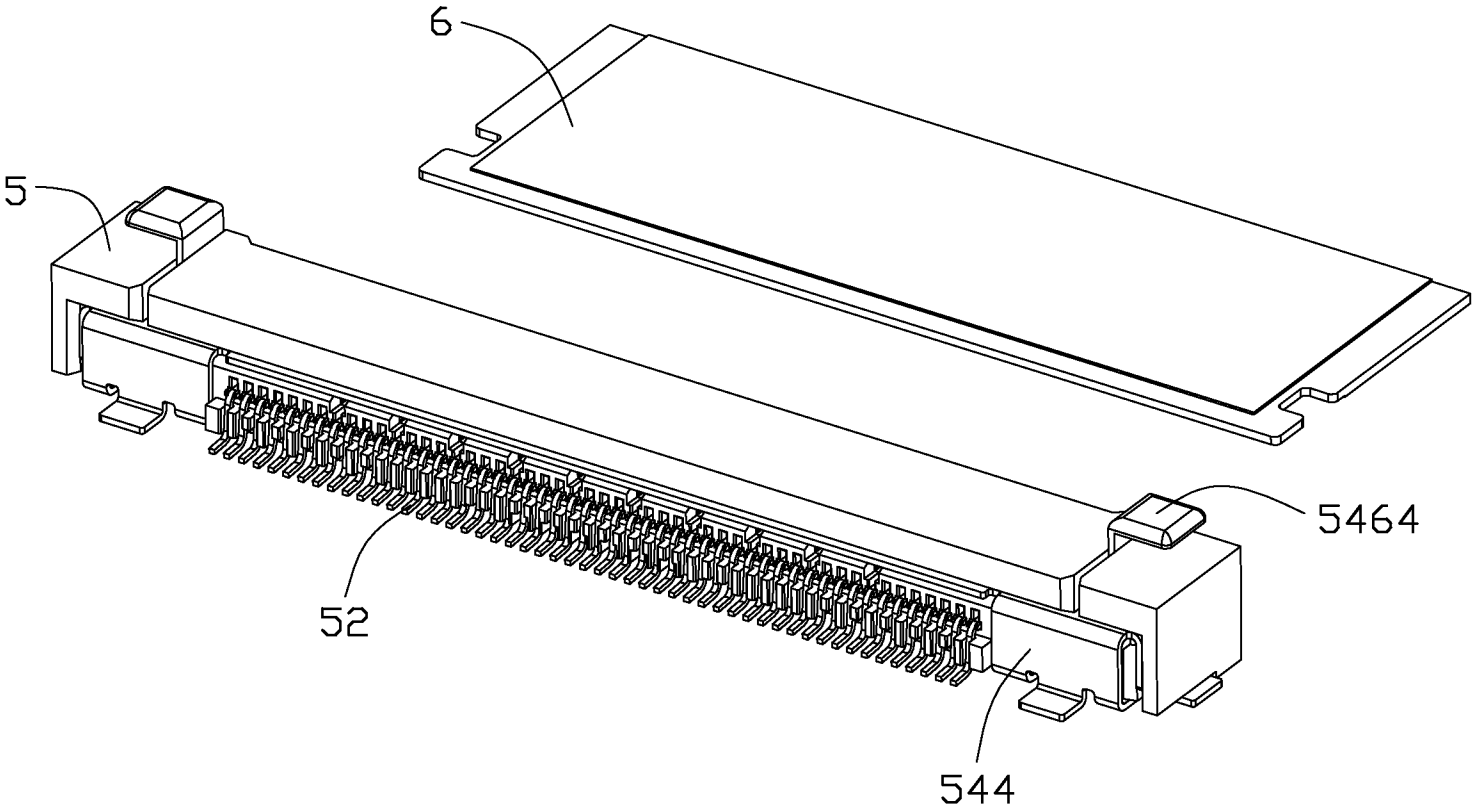
FIG. 13 is a rear perspective view of the assembly shown in FIG. 12.
Figure 14:
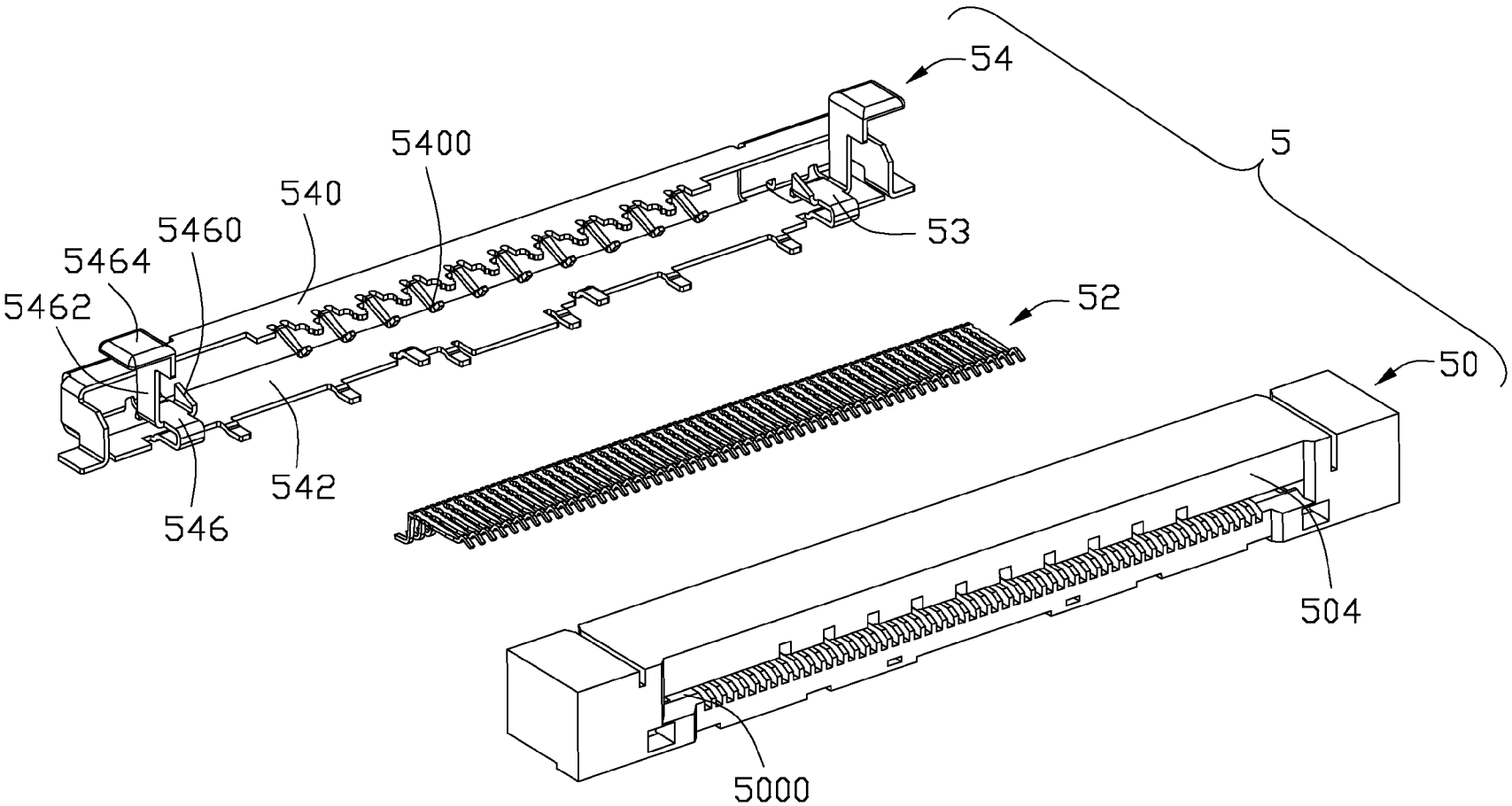
FIG. 14 is a front exploded perspective view of the electrical connector shown in FIG. 12.
Figure 15:
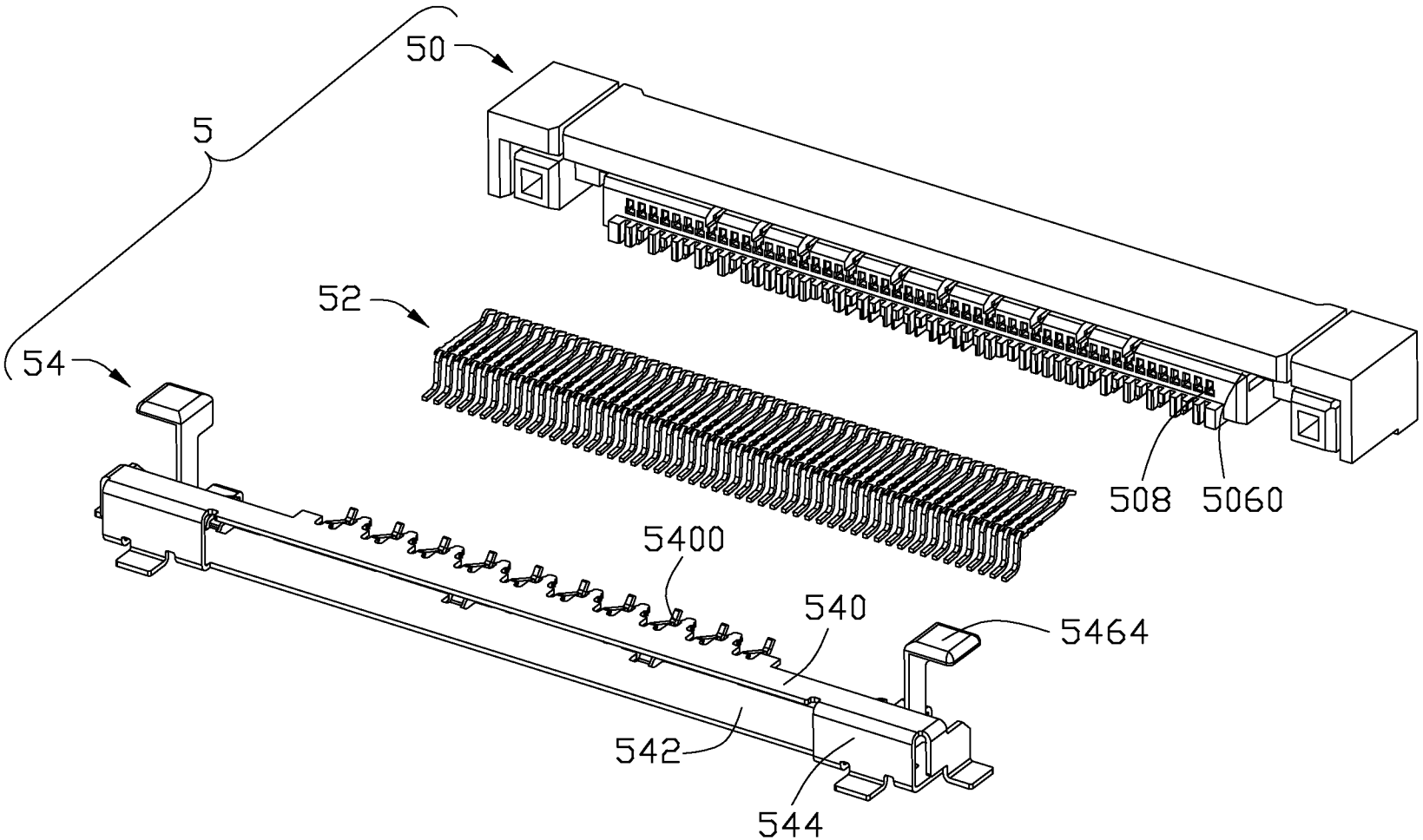
FIG. 15 is a rear exploded perspective view of the connector shown in FIG. 13.
Figure 16:
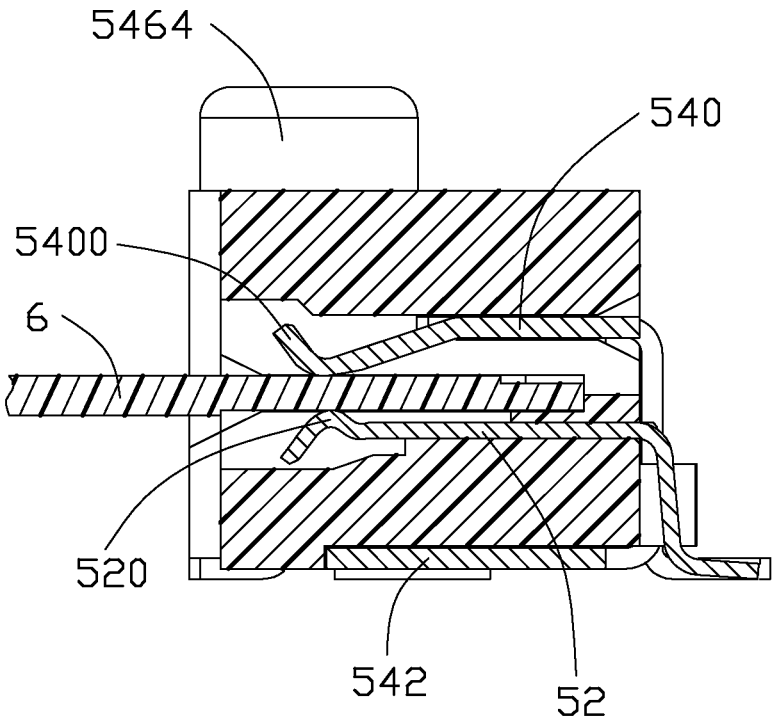
FIG. 16 is a cross-sectional view of the assembly taken along lines 16-16 in FIG. 10.
Figure 17:
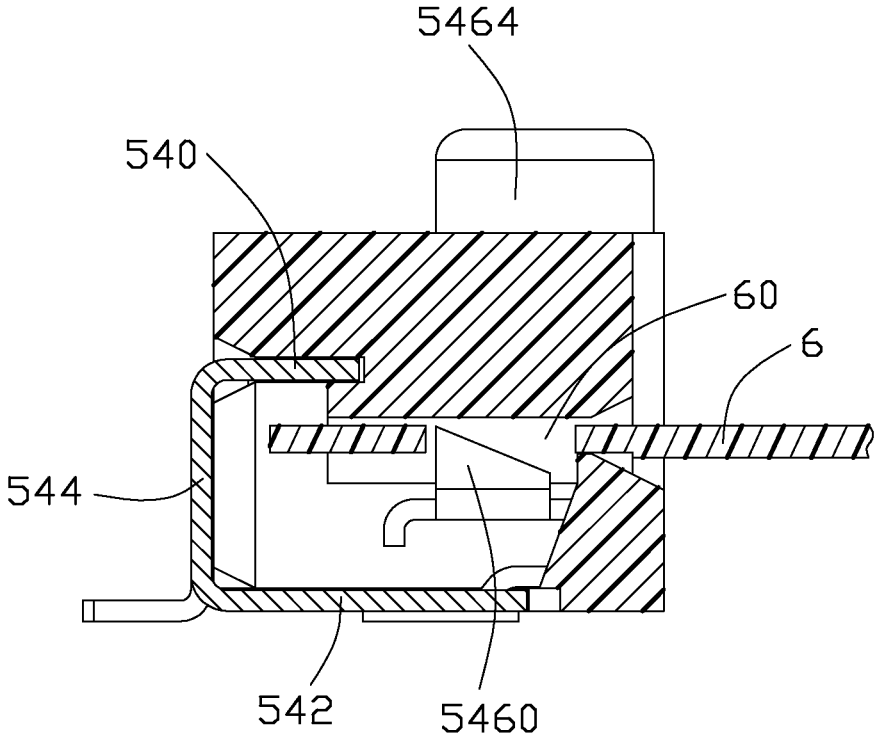
FIG. 17 is a cross-sectional view of the assembly taken along lines 17-17 in FIG. 10.

FIG. 8 illustrates the movement of the release portion 1426 and the locking portion 1424. The locking portion 1424 is disposed in the notch 20 during the board in a locking statue to prevent the board from escaping off the housing. FIG. 9 illustrates a disconnection of the board from the mating slot 1000. The locking portion 1424 shift downward and rearwards away from the mating slot, i.e. the board 2, in response to the downward movement of the release portion through a press force on the operating portion. The movement of the locking portion releases the locking statue of the locking portion to the disconnecting statue.

The locking portion and release portion deforms simultaneously since they are formed on one metal sheet and integrally formed with the shell 14. Therefore, the release process is quickly and simple.

Referring to FIGS. 10 through 18, a second embodiment of an electrical connector 5 according to certain teachings of the present disclosure is illustrated, which is intended to be mounted on a mother board and receiving flexible flat circuit board 5 so as to establish an electrical connection between the mother board and the flexible flat circuit board 6. All same and similar elements of the connector in the second embodiment to the first embodiment will be omitted and what is different from the first embodiment will be highlighted hereinafter.

Figure 18:
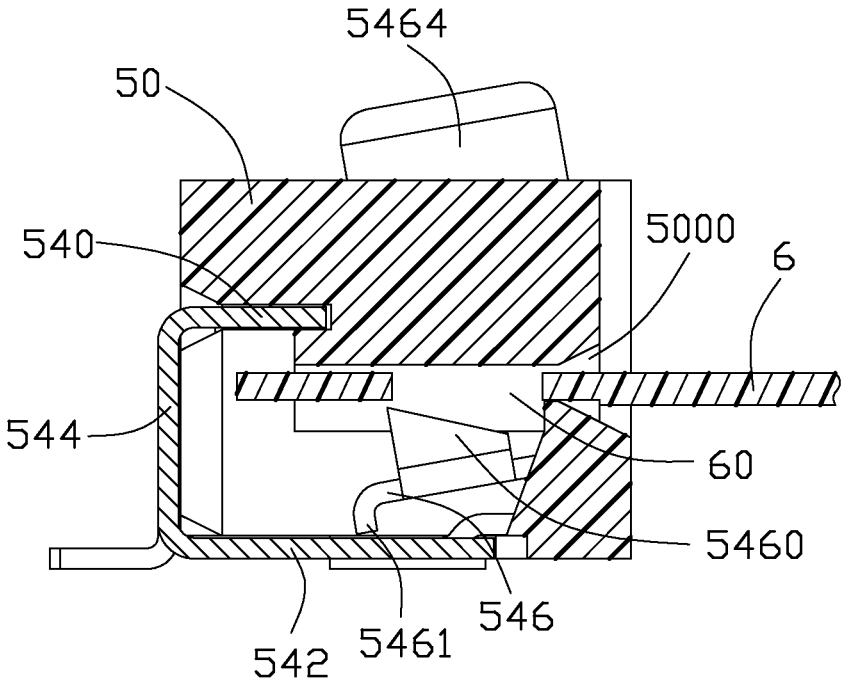
FIG. 18 is similar to FIG. 17, wherein the locking portion is pushed downward from the flexible flat circuit board.

The cantilever arm 53 of the shielding shell 54 includes a connecting portion 546 bending forwards from a rear edge of second wall 542. The locking portion or locking head 5460 project into the mating slot 5000 from one side of the connecting portion 546 so as to lock in the notch 60 of board 6 and the release portion 5462 extend upward from another side of the connecting portion 546 of the shell. The release portion exceeds the top face of the housing 50 and construed with a horizontal operating portion 5464. The spring fingers 5400 through a through slit 1060 are disposed at two opposite sides of the mating slots 5000 opening through a front face 504 and oppositely face to the contacting portion 520 of the contacts 52 which are on the bottom wall 502 of the housing 50. As best shown in FIG. 18, the connecting wall 54 cover on a rear face 508 of the housing and a free end 5461 of the connecting portion 546 bend towards the bottom wall 542 to prevent moving overly of the release portion.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising an insulating housing defining a mating slot;

a plurality of conductive terminals retained in the insulating housing, the terminals comprising contacting portions exposed to the mating slot and solder portions; and a shielding shell attached to the insulating housing;

wherein the shielding shell comprises a pair of connecting portions integrally extending in the mating slot, a locking portion integrally extending from each connecting portion and exposed to the mating slot and a releasing portion integrally extending from each connecting portion to the shell with an operating portion at one outer side of the connector;

wherein the locking portions move away from the mating slot in response to a movement of the releasing portions to the mating slot.

2. The electrical connector as described in claim 1, wherein the contacting portions of the terminals are disposed along a lower face of the mating slot, the lower face of the mating slot defines a cavity therein to accommodate locking portions and to allow the locking portions to shift therein driven by the release portion.

3. The electrical connector as described in claim 2, wherein the shielding shell comprises a plurality of spring fingers passing through the insulating housing and disposed along an upper face of the mating slot, the spring fingers are disposed oppositely to the contacting portions of the terminals.

4. The electrical connector as described in claim 2, wherein each releasing portion defines a vertical portion passing through a through slot defined in the insulating housing, and the operating portion bends from the vertical portion so as to parallel to a top inner face of the mating slot.

5. The electrical connector as described in claim 4, wherein the through slot is defined through a rear face and a top face of the insulating housing and the cavity is defined through the rear face of the housing.

6. The electrical connector as described in claim 1, wherein the connecting portion defines a first portion parallel to a top inner face of the mating slot, the locking portion extends from one side of the first portion of the connecting portion and a releasing portion extending from another side of the first portion of the connecting portion.

7. The electrical connector as described in claim 1, wherein shielding shell comprises a first wall and a second wall adjacent the solder portion of the terminals, the connecting portion extends from the first wall to the mating slot.

8. The electrical connector as described in claim 1, wherein shielding shell comprises a first wall and a second wall adjacent the solder portion of the terminals, the connecting portion extend from the second wall to the mating slot.

9. An electrical connector assembly comprising:

an insulative housing defining a receiving slot extending toward an exterior in a first direction for receiving a printed circuit board with a pair of notches in two opposite side regions thereof;

a plurality of contacts disposed in the housing with contacting sections exposed in the receiving slot and deflectable in a second direction perpendicular to said first direction; and a metallic shell enclosing said housing and unitarily formed with a pair of latches moveable up and down in the second direction, each of said latches defining a locking head extending into the receiving slot for latchable engagement within the notch of the printed circuit board, and a release portion spaced from the locking head in a third direction perpendicular to both said first direction and said second direction and further equipped with an operating portion extending above the locking head in the second direction; whereby imposing forces upon the operating portion results in movement of the locking head in the second direction for disengagement from the notch of the printed circuit board.

10. The electrical connector assembly as claimed in claim 9, wherein said first direction is a front-to-back direction, said second direction is a vertical direction, and said third direction is a longitudinal direction.

11. The electrical connector assembly as claimed in claim 9, wherein the metallic shell includes opposite upper and bottom horizontal walls and each of the latches includes a connecting portion linked to one of the upper and bottom horizontal walls, and said locking head is linked around an inner side of the connecting portion while said release portion is linked around an outer side of the connecting portion.

12. The electrical connector assembly as claimed in claim 11, wherein said locking head is up and down moveable in a tilted manner in the first direction.

13. The electrical connector assembly as claimed in claim 12, wherein when the connecting portion is linked to the upper horizontal wall, the locking head is tilted forwardly; when the connecting is linked to the lower horizontal wall, the locking head is tilted rearwardly.

14. The electrical connector assembly as claimed in claim 9, wherein said metallic shell further defines a plurality of spring fingers extending into the receiving slot opposite to contacting sections in the second direction.

15. The electrical connector assembly as claimed in claim 9, wherein the housing defines a slit to confine the release portion in the third direction.

16. An electrical connector assembly comprising:

an insulative housing extending along a longitudinal direction and defining a receiving slot extending toward an exterior in a front-to-back direction perpendicular to said longitudinal direction for receiving a printed circuit board with a pair of notches in two opposite side regions thereof;

a plurality of contacts disposed in the housing with contacting sections exposed in the receiving slot and deflectable in a vertical direction perpendicular to both said longitudinal direction and said front-to-back direction; and a pair of latches located around two opposite longitudinal ends of the housing in said longitudinal direction and moveable up and down relative to the housing in the vertical direction, each of said latches defining a locking head extending into the receiving slot for latchable engagement within the notch of the printed circuit board, and a release portion spaced from the locking head in the longitudinal direction and further equipped with an operating portion extending above the locking head in the vertical direction; whereby imposing forces upon the operating portion results in movement of the locking head in the vertical direction for disengagement from the notch of the printed circuit board.

17. The electrical connector assembly as claimed in claim 16, wherein said pair of latches are unified together via a metallic shell.

18. The electrical connector assembly as claimed in claim 17, wherein said shell includes opposite upper and bottom walls to sandwich said housing therebetween in the vertical direction, and each of the pair of latches is linked to one of said opposite upper and bottom walls.

19. The electrical connector assembly as claimed in claim 18, wherein the upper wall of the shell is equipped with a plurality of spring fingers extending into the receiving slot.

20. The electrical connector assembly as claimed in claim 18, wherein the latch is tilted along the front-to-back direction during downward moving.

* * * * *